US006643887B1

(12) United States Patent
Foley et al.

(10) Patent No.: US 6,643,887 B1
(45) Date of Patent: Nov. 11, 2003

(54) FOLDABLE TOOTHBRUSH

(75) Inventors: Kevin Foley, Kempton, PA (US); James O'Halloran, Kutztown, PA (US)

(73) Assignee: Radius Corporation, Kutztown, PA (US)

( * ) Notice: Subject to any disclaimer, the term of this patent is extended or adjusted under 35 U.S.C. 154(b) by 11 days.

(21) Appl. No.: 09/603,979

(22) Filed: Jun. 27, 2000

(51) Int. Cl.[7] ..... A46B 9/04; A46B 15/00
(52) U.S. Cl. ..... 15/185; 15/167.1
(58) Field of Search ..... 15/167.1, 184, 15/185; 132/308

(56) References Cited

U.S. PATENT DOCUMENTS

| | | | | |
|---|---|---|---|---|
| 564,739 | A | | 4/1896 | De Lent |
| 835,365 | A | * | 11/1906 | Morgan |
| 1,074,761 | A | | 10/1913 | Weiss |
| 1,104,365 | A | * | 7/1914 | Loughlin |
| 1,307,530 | A | | 6/1919 | Wolf |
| 1,392,285 | A | * | 9/1921 | Sprague |
| 2,391,651 | A | | 12/1945 | Smith |
| 2,454,995 | A | | 11/1948 | Curran |
| 2,790,449 | A | | 4/1957 | Hennings |
| 3,707,013 | A | | 12/1972 | Erkers |
| 4,482,263 | A | | 11/1984 | Palamara |
| 5,003,658 | A | | 4/1991 | Rolleri |
| 5,074,414 | A | | 12/1991 | Romana |
| D322,893 | S | | 1/1992 | Kihara |
| 5,083,336 | A | * | 1/1992 | Atsumi et al. |
| 5,432,971 | A | | 7/1995 | Chung |
| 5,464,294 | A | | 11/1995 | Chee |
| 5,476,334 | A | | 12/1995 | Tello-Vallarino |
| 5,735,298 | A | | 4/1998 | Mayne |

FOREIGN PATENT DOCUMENTS

| | | |
|---|---|---|
| EP | 235 671 | 9/1987 |
| EP | 0 235 671 B1 | 10/1990 |

OTHER PUBLICATIONS

PCT International Preliminary Examination Report, mailed Oct. 1, 2002 (citing and explaining EPO 235,671).

* cited by examiner

*Primary Examiner*—Randall E. Chin
(74) *Attorney, Agent, or Firm*—Fish & Richardson P.C.

(57) ABSTRACT

A foldable toothbrush having a self-contained storage compartment contiguous with the body of the toothbrush. A pair of storage compartments are connected to one another, one of which is, in turn, connected to an arm assembly. The arm assembly has a pair of members connected to each other. The toothbrush's bristles are attached to the outermost member of the arm assembly. In its fully folded position, the arm assembly's members fold down on one another to form a folded arm section which is folded into one of the storage compartments. The other storage compartment folds down onto the first storage compartment to yield a small, flat, cylindrical case which houses the toothbrush which can easily be stored in a purse or pocket. The foldable toothbrush is designed to be inexpensive enough to be disposable but sturdy enough to withstand repeated use.

21 Claims, 5 Drawing Sheets

FOLDABLE TOOTHBRUSH

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The present invention relates generally to dental care devices and, more specifically, to a foldable toothbrush which collapses into its own self-contained storage compartment.

2. Related Art

A variety of foldable dental care devices are described in the prior art. For example, U.S. Pat. No. 4,482,263 to Palamara, U.S. Pat. No. 5,003,658 to Rolleri and U.S. Pat. No. 5,464,294 to Chee et. al. each disclose a toothbrush assembly having a brush section which folds onto a handle section.

While these devices may be appropriate for the particular purpose for which they were designed, they do not provide the advantages of the present invention as described herein. Specifically, these designs only allow the toothbrush to be folded to approximately one-half of its original size. As such, they do not provide the compact design of the present invention. Further, these designs do not provide a mechanism for locking the structure in its fully folded position, thereby allowing for the introduction of dirt and other contaminants onto the tooth brushing surface. Similarly, these designs do not provide a mechanism for locking the structure in its fully opened, operational position, allowing the toothbrush to possibly collapse during use. Further still, none of the designs of the prior art has the novel feature of the present invention in which, as more fully described below, the bristles lay flat when the toothbrush is in its fully folded position, thereby permitting the compact toothbrush of this invention to be folded into a relatively thin package suitable to be carried unobtrusively in a pocket or a purse.

SUMMARY OF THE INVENTION

Using a toothbrush to brush one's teeth is the principal means for practicing good dental hygiene. This activity normally takes place in one's home. Brushing when away from home may present a number of difficulties.

First, the size and shape of a conventional toothbrush make it inconvenient to carry on one's person. Also, once used, the bristles of the toothbrush are typically moist which is not conducive to carrying in a pocket or purse unless the bristles are somehow covered. In addition, because the bristles are not stored in a covered environment, they may come into contact with various contaminants leading to a non-hygienic condition.

It is therefore an object of the present invention to provide an improved foldable toothbrush.

A further object of the present invention is to provide an improved foldable toothbrush which is configured to be easily carried in the pocket, purse or travel kit.

Another object of the present invention is to provide an improved foldable toothbrush which is adapted to be disposed of after a single use but which can be used, if desired, numerous times. A related object is to provide such a foldable toothbrush which may be constructed at low cost.

It is another object of the present invention to provide a foldable toothbrush which, when stored, maintains the brushing surface clean.

It is another object of the invention to provide a foldable toothbrush which locks in the fully opened position to facilitate the brushing of one's teeth.

It is still another object at the present invention to provide a foldable toothbrush which locks when placed in the fully folded position so that the brush bristles are somewhat sealed from the ambient atmosphere, thereby protecting the brush bristles from dirt and other contaminants.

Accordingly, the above objects are met or exceeded by a foldable toothbrush having a self-contained storage compartment. The device includes a pair of storage sections foldably connected to each other, one of which is, in turn, foldably connected to a first toothbrush section which is, in turn, foldably connected to a second toothbrush section.

When in use, the device is placed in the fully extended position and folded about its axis of symmetry. A locking mechanism keeps the toothbrush in the fully opened position. When stored, the device collapses on itself and folds into the storage compartment which is contiguous with the toothbrush's body. In its fully folded position, the device collapses into a coin-shaped structure, less than two-inches in diameter and one-half inch in thickness.

Various other objects, features and attendant advantages of the present invention will become more fully appreciated upon review of the following detailed drawings and detailed description.

DETAILED DESCRIPTION OF THE INVENTION'S PREFERRED EMBODIMENT

Figure 1:
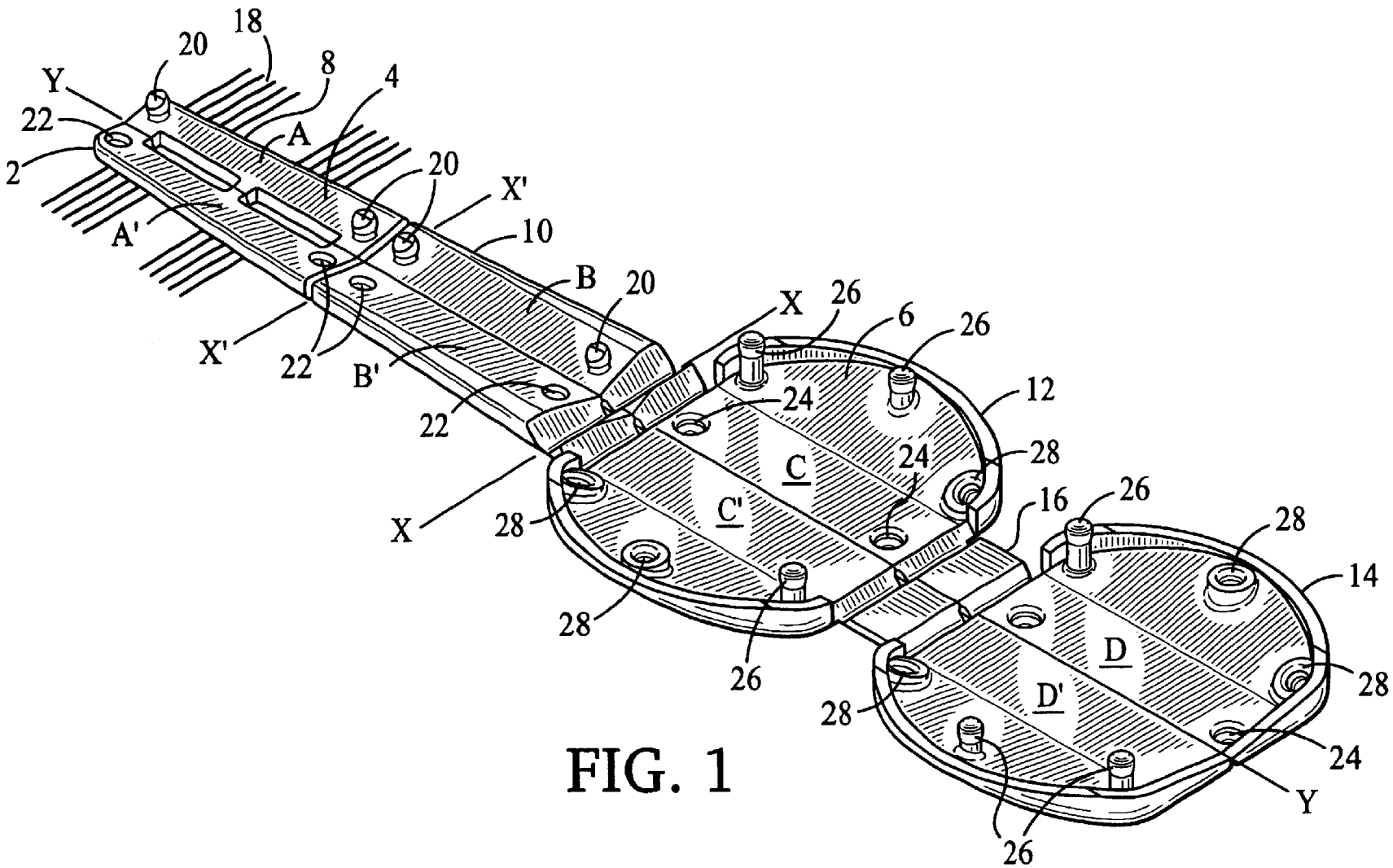
FIG. 1 is a perspective view of the present invention in the unfolded position.

In the following drawings, similar reference numerals denote similar elements throughout the several views.

FIG. 1 illustrates a foldable toothbrush 2 in the fully unfolded position. The toothbrush 2 has an arm assembly 4 and a storage compartment 6. The arm assembly 4 has a distal member 8 and a proximal member 10 which are foldably connected to each other about axis x'—x', thereby allowing the arm assembly 4 to fold about itself. The storage compartment 6 has a first storage section 12 and a second storage section 14 which are foldably connected to each other through an expansion plate 16. The first storage compartment 12 and the proximal member 10 of the arm assembly 4 are similarly foldably connected to each other along axis x—x. Bristles 18 are affixed to the outer edge of the distal member 8 of the arm assembly 4 such that they lie in the same plane as the fully unfolded toothbrush as depicted in FIG. 1. As more fully explained below, this configuration of the bristles allows the toothbrush to be folded into a thinner arrangement when placed in the fully folded position.

Figure 2:
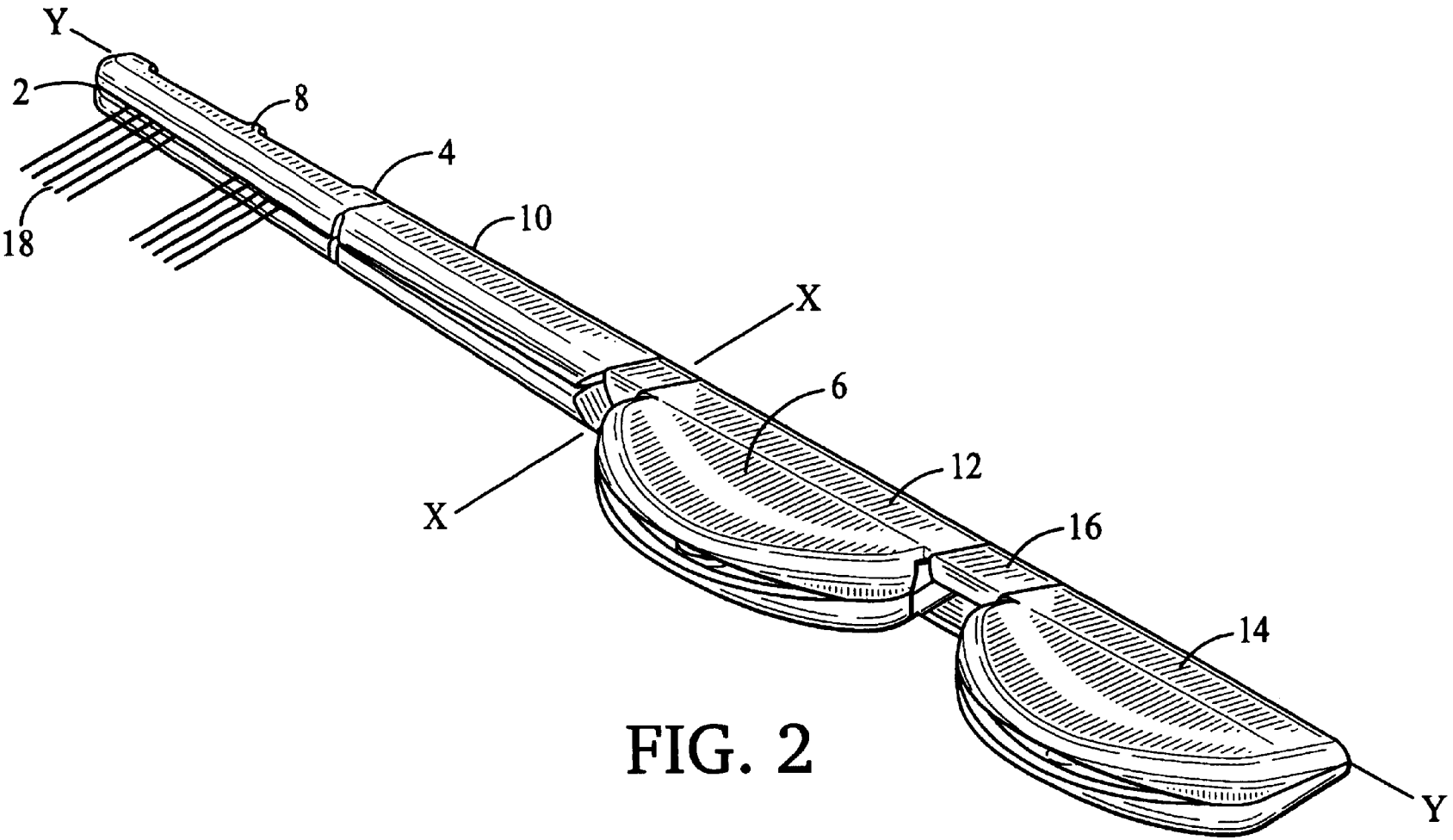
FIG. 2 is a perspective view of the present invention in the fully opened, operational position.
Figure 3:
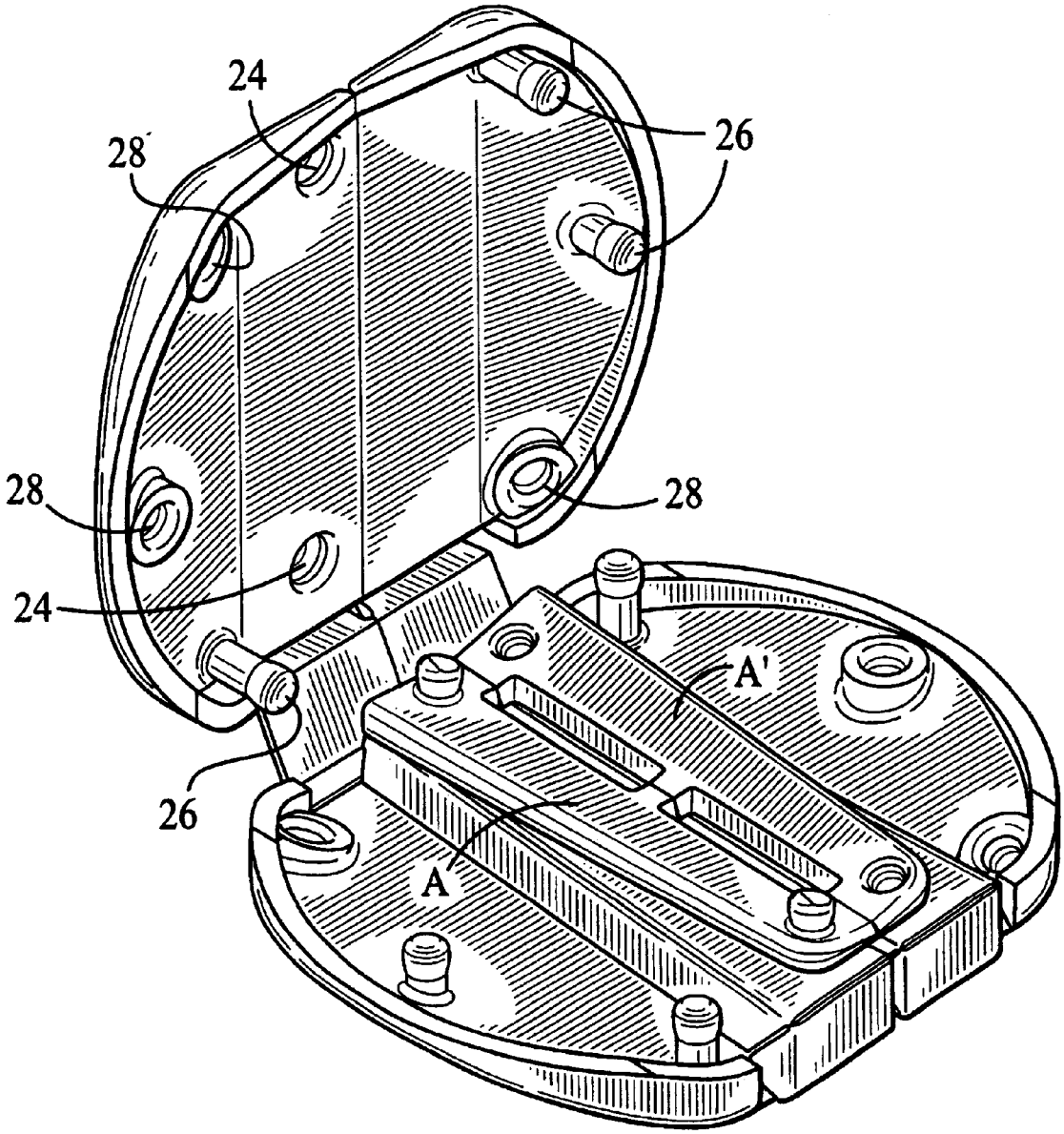
FIG. 3 is a perspective view of the present invention in the partially opened position.

Referring further to FIG. 1, to place the toothbrush in the fully open, operational position in which it can be used to brush one's teeth, the user folds the apparatus along axis y—y so that faces A and B of arm assembly 4 meet faces A' and B', respectively, of arm assembly 4 and faces C and D of storage compartment 6 meet faces C' and D', respectively, of storage compartment 6. Bristles 18 positioned on either side of distal member 8 come together to form the tooth brushing surface. Protrusions 20 located on arm assembly 4 snap into openings 22 on arm assembly 4. Similarly, protrusions 26 located on storage compartment 6 snap into openings 28 on storage compartment 6. This allows the toothbrush 2 to be locked into its fully open, operational position as depicted in FIG. 2. The device is now in position for the user to brush his or her teeth.

Referring now to FIG. 2, first storage section 12 and second storage section 14, joined by expansion plate 16, form the handle of the toothbrush. Arm assembly 4 forms the body of the toothbrush. Toothpaste can be applied to the bristles 18 prior to brushing one's teeth. The user grasps the toothbrush in a manner such that his or here palm is placed against the rounded side of storage compartment 6 with the thumb extended upward towards the bristles. The toothbrush is equally adaptable for either right-handed or left-handed use.

Figure 4:
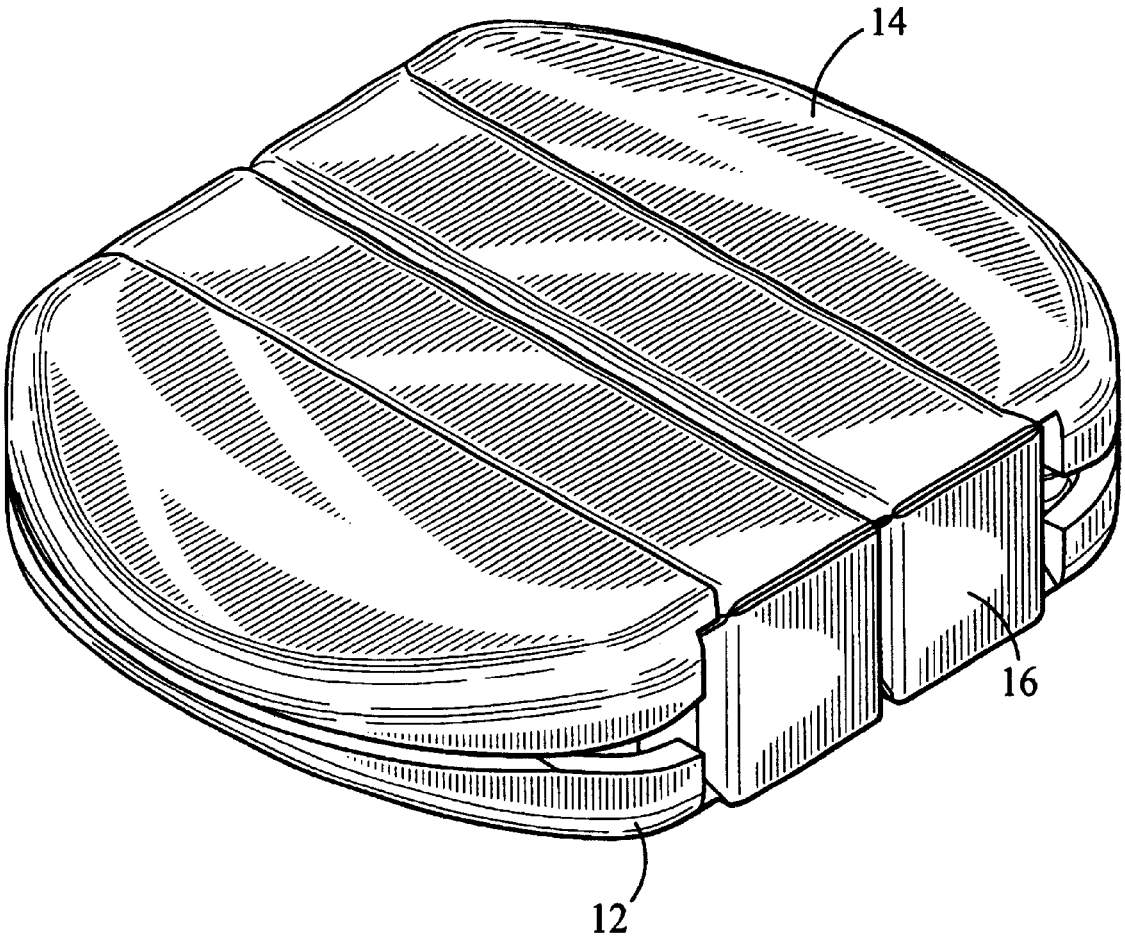
FIG. 4 is a perspective view of the present invention in the fully closed or stored position.

After use, the device is stored by first unfolding the apparatus along axis y—y, thereby removing protrusions 20 on arm assembly 4 from openings 22 and protrusions 26 on storage compartment 6 from openings 28. As a result, faces A and B of arm assembly 4 are separated from faces A' and B', respectively, of arm assembly 4, and faces C and D of storage compartment 6 are separated from faces C' and D', respectively, of storage compartment 6. This restores the toothbrush to the position illustrated by FIG. 1. The device is then folded along line x—x so that faces A, B, A', and B' of arm section 4 meet faces C, D, C' and D', respectively, of storage compartment 6. Protrusions 20 located on arm assembly 4 snap into openings 24 located on storage compartment 6. First storage section 12 is then folded down onto second storage section 14 with protrusions 26 snapping into openings 28. Expansion plate 16 allows the storage compartment 6 to expand in order to accept the folded arm assembly 4. This places the device in the fully stored position as depicted in FIG. 4.

Significantly, the particular orientation of bristles 18 allow for the toothbrush to achieve a greater degree of compactness when placed in the fully folded position. Because the bristles 18 are mounted on either side of distal member 8, they lie parallel with, as opposed to perpendicular to, the plane of the fully unfolded toothbrush. Accordingly, when arm assembly 4 is folded about axis x—x and distal member 8 comes to rest on second storage section 14, bristles 18, again lie in the plane of the toothbrush. As such, the distance between first storage section 12 and second storage section 14 can be kept to a minimum as it is limited only by the thickness of arm assembly 4 and not the length of bristles 18.

Figure 5:
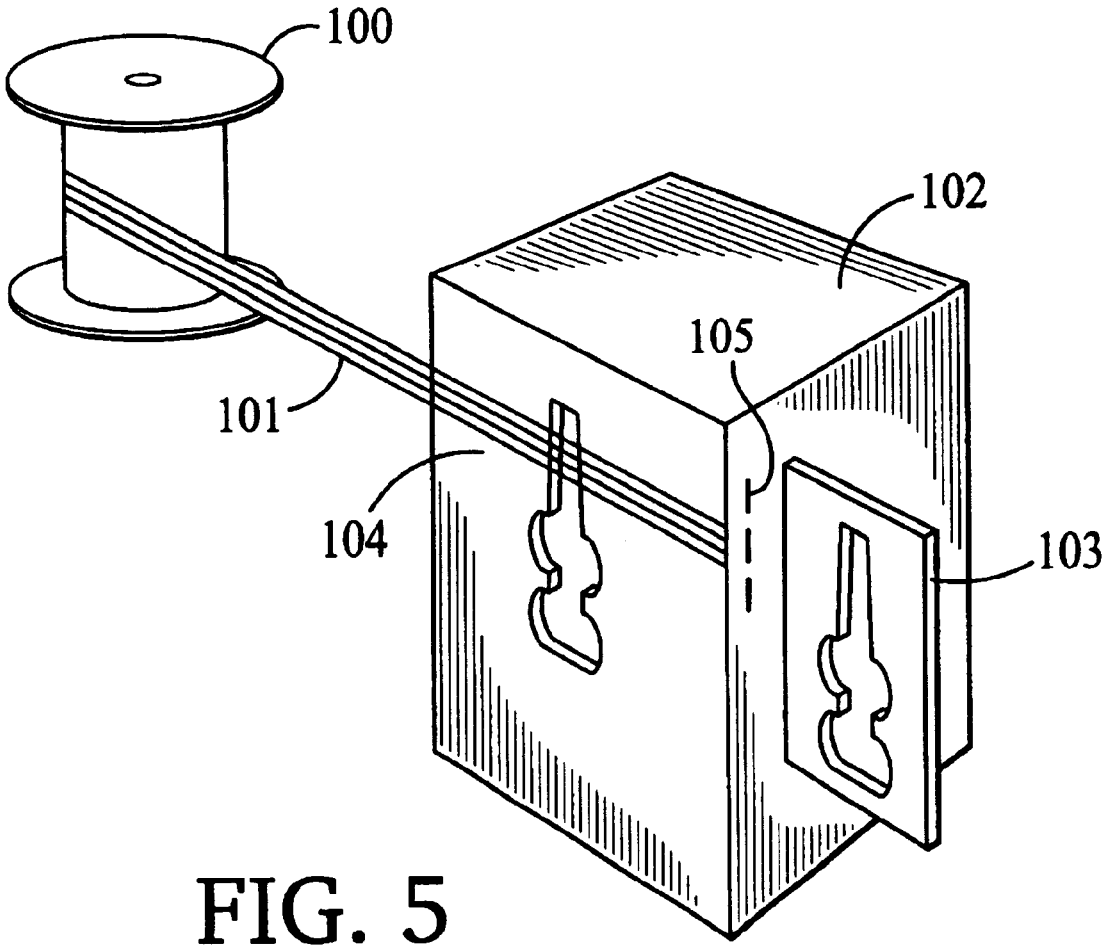
FIG. 5 is a schematic of the preferred embodiment of the molding process.

A number of known molding techniques can be used to manufacture the foldable toothbrush of the present invention. In the preferred embodiment, the foldable toothbrush is injection molded from polypropylene in a four-step process which will now be described. Referring to FIG. 5, a spool 100 contains a length of nylon thread 101 which is used to form the bristles 18 of the foldable toothbrush 2. Initially, the nylon thread 101 is fed from the spool 100 into a mold 102, across the guide grooves 104. The mold 102 is then closed about the thread.

In the first step, the mold 102 is closed and the polypropylene forming the body of the foldable toothbrush 2 is injected into the mold 102.

In the second step, the polypropylene is cooled, the mold 102 is opened and the foldable toothbrush 2 is ejected and grasped by a robotic fixture 103 which slides across the face of the mold 102 in the direction indicated in FIG. 6.

In the third step, the robotic fixture 103 slides back across the face of the mold 102 to its original position (i.e., its position before step 2), removing the foldable toothbrush 2 from the mold 102 in the process. As the foldable toothbrush 2 is removed from the mold 102 by the robotic fixture 103, the nylon thread 101 is pulled off the spool 100 and across the face of the mold 102 for the molding step of the next unit.

In the fourth step, when the mold 102 is closed for the next cycle, a cutting mechanism 105 trims the bristles 18. When the mold 102 opens and step 2 is repeated for the next toothbrush, the trimmed toothbrush is ejected from the robotic fixture 103 before it slides into the mold 102 to pick up the next unit.

In the preferred embodiment, the foldable toothbrush of the present invention in the fully unfolded position measures approximately 6½" in length (i.e., along axis y—y). Each of the first storage section 12 and second storage section 14 has a radius of approximately 1⅞". In width (i.e., along axis x—x), arm member 4 measures approximately ⅖' at the outer tip of distal member 8 and approximately ¾" at its foldable connection with first storage section 12. Arm assembly 4 measures approximately 3" in length. Expansion plate 16 measures approximately ⅖" in height and ¾" in width.

Additionally, arm assembly 4 measures approximately ⅛" in thickness and each of first Storage section 12 and second storage section 14 measure approximately ⅕". Therefore, in its fully folded configuration, the foldable toothbrush of the present invention measures approximately ⅖" in thickness.

A specific embodiment of the novel foldable toothbrush according to the present invention has been described for the purposes of illustrating the manner in which the invention can be used. It should be understood that implementation of other variations and modifications of the invention in its various aspects will be apparent to those skilled the art, and that the invention is not limited by the specific embodiment described. It is therefore contemplated that the present invention covers any and all modifications, variations, or equivalents that fall within the true spirit and scope of the basic underlying principles disclosed and claimed herein.

What is claimed is:

1. A foldable toothbrush comprising:

a storage compartment having a fist storage section and a second storage section, said first storage section being foldably connected to said second storage section;

an arm assembly having a distal member and a proximal member, said distal member being foldably connected to said proximal member and said proximal member being foldably connected to said fist storage section, said arm assembly being adapted to fold into and lie in its entirety atop of said storage compartment;

a longitudinal folding axis extending the length of said arm assembly and dividing said distal arm assembly member into first and second foldably connected sections; and first and second portions of a dividable brushing surface formed by the end of bristles respectively extending from said first and second sections of said distal arm assembly member, laterally corresponding points of said first and second portions of said brushing surface being substantially equidistant from said longitudinal axis.

2. The foldable toothbrush according to claim 1 wherein said bristles are attached to said distal member of said arm assembly.

3. The foldable toothbrush according to claim 1 having means to secure said first storage section to said second storage section when said foldable toothbrush is in a fully closed position.

4. The foldable toothbrush according to claim 3 wherein said means comprises a protrusion opening connector.

5. The foldable toothbrush according to claim 1 wherein said foldable toothbrush is foldable about an axis of symmetry running from said distal member of said arm assembly to said second storage section of said storage compartment.

6. The foldable toothbrush according to claim 5 having means to secure said foldable toothbrush in place when said foldable toothbrush is folded about said axis.

7. The foldable toothbrush according to claim 6 said means comprises a protrusion-opening connector.

8. The foldable toothbrush according to claim 1 wherein said first storage section is foldably connected to said second storage section through an expansion plate.

9. The foldable toothbrush according to claim 1 having means to secure said arm assembly to said first storage section when said arm assembly is folded into said storage compartment.

10. The foldable toothbrush according to claim 9 wherein said means comprises a protrusion-opening connector.

11. The foldable toothbrush according to claim 1 having means to secure said distal member of said arm assembly to said second storage section and said proximal member to said first storage section when said foldable toothbrush is in the fully folded position.

12. The foldable toothbrush according to claim 11 wherein said means comprises a protrusion-opening connector.

13. A foldable toothbrush comprising:

a storage compartment having a first storage section and a second storage section, said first storage section being foldably connected to said second storage section;

an arm assembly foldably connected to said first storage section, said arm assembly being adapted to fold into and lie atop of said storage compartment;

a longitudinal folding axis extending the length of said arm assembly and dividing said arm assembly into first and second foldably connected sections; and first and second portions of a dividable brushing surface formed by the end of bristles respectively extending from said first and second sections of said arm assembly, laterally corresponding points of said first and second portions of said brushing surface being substantially equidistant from said longitudinal axis.

14. The foldable toothbrush according to claim 13 wherein said arm assembly has a distal member and a proximal member, said distal member being foldably connected to said proximal member.

15. The foldable toothbrush according to claim 14 having means for securing said distal member to said second storage section and said proximal member to said first storage section.

16. The foldable toothbrush according to claim 15 wherein said means comprises a protrusion-opening connector.

17. The foldable toothbrush according to claim 14 where said bristles are attached to said distal member of said arm assembly.

18. The foldable toothbrush according to claim 13 having means for securing said foldable toothbrush into a fully operational position.

19. The foldable toothbrush according to claim 18 wherein said means comprises a protrusion-opening connector.

20. The foldable toothbrush according to claim 13 having means to secure said first storage section to said second storage section when said foldable toothbrush is in a fully closed position.

21. The foldable toothbrush according to claim 20 wherein said means comprises a protrusion-opening connector.

* * * * *